US011512840B2

(12) United States Patent
Jackson et al.

(10) Patent No.: US 11,512,840 B2
(45) Date of Patent: Nov. 29, 2022

(54) SYSTEM, APPARATUS, AND METHOD FOR PROVIDING AMBIENT LIGHTING

(71) Applicant: Blink Tech LLC, Holladay, UT (US)

(72) Inventors: Isaac Jackson, Salt Lake City, UT (US); Ronald E. Madsen, Jr., West Valley, UT (US); Theodore Espíritu, Salt Lake City, UT (US); Daniel Stuart, Layton, UT (US); Zach Henderson, South Weber, UT (US)

(73) Assignee: BLINK TECH LLC

( * ) Notice: Subject to any disclaimer, the term of this patent is extended or adjusted under 35 U.S.C. 154(b) by 0 days.

(21) Appl. No.: 17/325,185

(22) Filed: May 19, 2021

(65) Prior Publication Data

US 2021/0364155 A1 Nov. 25, 2021

Related U.S. Application Data

(60) Provisional application No. 63/027,171, filed on May 19, 2020.

(51) Int. Cl.

| | |
|---|---|
| ***F21V 21/096*** | (2006.01) |
| ***F21V 21/08*** | (2006.01) |
| ***F21Y 115/10*** | (2016.01) |

(52) U.S. Cl.

CPC ..... *F21V 21/0965* (2013.01); *F21V 21/0816* (2013.01); *F21Y 2115/10* (2016.08)

(58) Field of Classification Search

CPC ..... F21V 21/0965; F21V 21/0816; F21V 21/088; F21V 21/0885; F21V 15/01; A41F 1/002; A44D 2203/00; A44C 5/16; A44C 5/2071; H01F 7/0263; G06F 1/163

See application file for complete search history.

(56) References Cited

U.S. PATENT DOCUMENTS

| | | | | |
|---|---|---|---|---|
| 1,764,175 | A * | 6/1930 | Kerkhoff | G09F 7/06 40/618 |
| 3,112,889 | A * | 12/1963 | Marmo | F21V 21/0816 362/103 |
| 4,941,236 | A * | 7/1990 | Sherman | A44C 5/2071 24/265 WS |
| 5,359,501 | A * | 10/1994 | Stevens | A41F 9/002 362/108 |
| 5,425,007 | A * | 6/1995 | Walter | A44C 5/22 224/176 |
| 5,434,759 | A * | 7/1995 | Endo | G09F 13/22 362/108 |
| 6,056,412 | A * | 5/2000 | Atlee | F21L 15/14 224/660 |
| 6,170,959 | B1 * | 1/2001 | Richardson, III | G08B 5/004 359/516 |

(Continued)

*Primary Examiner* — Jong-Suk (James) Lee
*Assistant Examiner* — James M Endo
(74) *Attorney, Agent, or Firm* — Kunzler Bean & Adamson

(57) ABSTRACT

A system for providing ambient lighting includes a lighting apparatus, which includes a housing, a plurality of light emitting diodes positioned within the housing and configured to emit non-focused light to an exterior of the housing, at least one charge port formed in the housing, and a control interface integrated into the housing. The system also includes a band coupled to the housing and includes a first end, a second end, a first magnetic element, and a second magnetic element coupleable with the first magnetic element such that the band forms a loop.

18 Claims, 6 Drawing Sheets

(56) References Cited

U.S. PATENT DOCUMENTS 6,213,619 B1 * 4/2001 Yu ..... A45F 5/02 116/DIG. 44
6,546,603 B1 * 4/2003 Wang ..... A44B 18/0023 24/265 WS
6,733,150 B1 * 5/2004 Hanley ..... A42B 1/244 2/209.13
6,805,460 B1 * 10/2004 Zoller ..... A01K 27/006 362/103
6,877,875 B2 * 4/2005 Yu ..... A42B 3/044 362/105
7,568,813 B2 * 8/2009 Barker ..... F21L 4/04 362/103
7,857,478 B1 * 12/2010 Keller ..... F21V 21/0816 362/103
8,303,129 B1 * 11/2012 Thielen ..... F21V 21/0832 362/103
8,752,974 B2 * 6/2014 Leibowitz ..... A63B 71/0686 362/103
9,523,965 B2 * 12/2016 Liao ..... G04G 17/06
2003/0016527 A1 * 1/2003 Rowe ..... F21L 4/00 362/103
2005/0225968 A1 * 10/2005 Hatherill ..... H02J 7/007182 362/157
2006/0226181 A1 * 10/2006 Bertucci ..... A44C 5/0053 224/164
2007/0195520 A1 * 8/2007 O'Brien ..... F21V 21/0816 362/191
2008/0151559 A1 * 6/2008 Chen ..... F21V 21/0965 362/368
2010/0157581 A1 * 6/2010 Galli ..... F21L 4/027 362/158
2010/0300146 A1 * 12/2010 Klecka ..... A44C 25/007 63/3
2011/0007502 A1 * 1/2011 Chen ..... F21V 21/0832 362/191
2012/0307506 A1 * 12/2012 Gunn ..... F21L 4/005 362/382
2013/0194784 A1 * 8/2013 Yu ..... F21V 21/145 362/108
2013/0301242 A1 * 11/2013 Sharrah ..... F21V 15/01 362/105
2014/0000312 A1 * 1/2014 Nicolas ..... A44C 5/2071 63/3.2
2014/0085872 A1 * 3/2014 Taylor ..... F21L 4/00 362/106
2014/0268710 A1 * 9/2014 Murano ..... F21L 4/00 362/191
2015/0237938 A1 * 8/2015 O'Neill ..... B60P 7/0823 2/322
2015/0345760 A1 * 12/2015 Law ..... F21V 21/0816 362/105
2016/0003269 A1 * 1/2016 Russell-Clarke ..... A45F 5/00 24/303
2016/0007697 A1 * 1/2016 de Jong ..... G06F 1/1637 361/679.03
2016/0037841 A1 * 2/2016 Dey ..... A44C 5/02 2/170
2016/0040698 A1 * 2/2016 Perkins ..... F16B 2/06 24/664
2016/0198813 A1 * 7/2016 Fiedler ..... H04B 1/385 224/183
2016/0282899 A1 * 9/2016 Inagaki ..... H04B 5/0075
2017/0175997 A1 * 6/2017 Rosenblum ..... A61H 3/04
2017/0234340 A1 * 8/2017 Pensak ..... A41F 1/002 24/3.1
2019/0029373 A1 * 1/2019 Shaffer ..... G04B 37/1486
2019/0033787 A1 * 1/2019 Swanagin ..... F21L 4/02
2019/0072268 A1 * 3/2019 Tomita ..... F21V 21/0816
2019/0250564 A1 * 8/2019 Mishima ..... A44C 5/16
2020/0003371 A1 * 1/2020 Ganahl ..... F21V 31/005

* cited by examiner

SYSTEM, APPARATUS, AND METHOD FOR PROVIDING AMBIENT LIGHTING

FIELD

This disclosure relates generally to a system, an apparatus, and a method for providing ambient lighting, and more particularly to wearable ambient lighting apparatuses and components.

BACKGROUND

Ambient, non-focused, lighting is beneficial in a wide variety of locations and under different circumstances. Many modular and/or wearable devices provide lighting. However, often such devices must be held during use, which occupies the hands of a user and restricts the ability of the user to perform manual operations, such as those that require both hands of the user. Moreover, traditional modular and/or wearable devices are not configured for convenient attachment to objects when not held or worn by the user. Additionally, the lighting provided by traditional modular and/or wearable devices is directionally focused, thus providing focused light only to a limited area.

Some lighting devices, such as traditional headlamps, can be cumbersome to wear. For example, traditional headlamps can be difficult to fit and make secure on a user's head. Moreover, headlamps often conflict or limit the use of other headwear. Traditional headlamps also provide only perspective-oriented lighting, which may create unwanted visual effects. Furthermore, the location of the light source on the head can make face-to-face conversation difficult or unnatural. Also, traditional headlamps are not equipped to attach to objects other than the head of the user and thus fail to provide light from a location other than the user's head.

Other modular and/or wearable devices, such as cell phones and smart watches, while providing some lighting capability, do not provide lighting as a primary feature of the devices. Accordingly, the quality and intensity of the lighting provided by such devices is lacking for lighting-intensive applications.

SUMMARY

The subject matter of the present application has been developed in response to the present state of the art, and in particular, in response to the problems and needs of conventional modular and/or wearable devices and methods that provide lighting that have not yet been fully solved. In view of the foregoing, the subject matter of the present application has been developed to provide a system, apparatus, and method for providing wearable and modular ambient lighting that overcome many of the shortcomings of the prior art.

Disclosed herein is a system for providing ambient lighting. The system comprises a lighting apparatus, which comprises a housing, a plurality of light emitting diodes positioned within the housing and configured to emit non-focused light to an exterior of the housing, at least one charge port formed in the housing, and a control interface integrated into the housing. The system also comprises a band coupled to the housing and comprising a first end, having a first magnetic element, and a second end, having a second magnetic element coupleable with the first magnetic element such that the band forms a loop. The preceding subject matter of this paragraph characterizes example 1 of the present disclosure.

The housing is made of nylon. The preceding subject matter of this paragraph characterizes example 2 of the present disclosure, wherein example 2 also includes the subject matter according to example 1, above.

The housing comprises a flat front face and a flat rear face opposite and parallel with the flat front face. The housing additionally comprises at least one window formed in the flat front face and through which the non-focused light from the plurality of light emitting diodes passes. The housing also comprises opposing rounded edges defining continuously rounded surfaces extending from the flat front face to the flat rear face, and opposing flat edges, perpendicular to the opposing rounded edges and extending from the flat front face to the flat rear face. The preceding subject matter of this paragraph characterizes example 3 of the present disclosure, wherein example 3 also includes the subject matter according to any one of examples 1-2, above.

The first magnetic element comprises a plurality of magnetic segments that are movable relative to each other. The second magnetic element comprises a plurality of magnetic segments that are movable relative to each other. The preceding subject matter of this paragraph characterizes example 4 of the present disclosure, wherein example 4 also includes the subject matter according to any one of examples 1-3, above.

The lighting apparatus comprises at least three light emitting diodes. The preceding subject matter of this paragraph characterizes example 5 of the present disclosure, wherein example 5 also includes the subject matter according to any one of examples 1-4, above.

The housing comprises a front face. The at least three light emitting diodes are spaced apart from each other and linearly aligned across the front face of the housing. The preceding subject matter of this paragraph characterizes example 6 of the present disclosure, wherein example 6 also includes the subject matter according to example 5, above.

The at least three light emitting diodes comprises two white-light emitting diodes and one red-light emitting diode interposed between the two white-light emitting diodes. The preceding subject matter of this paragraph characterizes example 7 of the present disclosure, wherein example 7 also includes the subject matter according to any one of examples 5-6, above.

At least one of the at least three light emitting diodes emits light in a first direction. At least one of the at least three light emitting diodes emits light in a second direction that is different than the first direction. The preceding subject matter of this paragraph characterizes example 8 of the present disclosure, wherein example 8 also includes the subject matter according to any one of examples 5-7, above.

The first end of the band is fixed to the connector. The second end of the band is passable through the connector. The connector is configured to breakaway from the first end under a first physical load applied to the system. The second magnetic element is coupleable with the first magnetic element via a magnetic force between the second magnetic element and the first magnetic element. The first physical load is less than the magnetic force. The preceding subject matter of this paragraph characterizes example 9 of the present disclosure, wherein example 9 also includes the subject matter according to any one of examples 1-8, above.

The plurality of light emitting diodes emit light in the same direction. The preceding subject matter of this paragraph characterizes example 10 of the present disclosure, wherein example 10 also includes the subject matter according to any one of examples 1-9, above.

The system further comprises a battery housed within the housing. The light emitting diodes emit light at a constant intensity independent of a depletion level of the battery. The preceding subject matter of this paragraph characterizes example 11 of the present disclosure, wherein example 11 also includes the subject matter according to any one of examples 1-10, above.

The system further comprises an electrical circuit between the battery and the light emitting diodes, wherein the electrical circuit comprises a boost-mode switching regulator. The preceding subject matter of this paragraph characterizes example 12 of the present disclosure, wherein example 12 also includes the subject matter according to example 11, above.

The control interface is a single-operation interface. The preceding subject matter of this paragraph characterizes example 13 of the present disclosure, wherein example 13 also includes the subject matter according to any one of examples 1-12, above.

The housing comprises a front face and the non-focused light is emitted through the front face. The housing also comprises a rear face opposite the front face, opposing retaining flaps defining the rear face, and a band slot defined between the opposing retaining flaps. The opposing retaining flaps couple the band to the housing. The band slot has a width that is less than a width of the band. The band is passable through the band slot. The preceding subject matter of this paragraph characterizes example 14 of the present disclosure, wherein example 14 also includes the subject matter according to any one of examples 1-13, above.

The band is slidable along the opposing retaining flaps while the opposing retaining flaps couple the band to the housing. The preceding subject matter of this paragraph characterizes example 15 of the present disclosure, wherein example 15 also includes the subject matter according to example 14, above.

The band is made of a laminated nylon material comprising at least two layers of nylon fabric bonded together in a stacked arrangement. The band is passable through the band slot. The preceding subject matter of this paragraph characterizes example 16 of the present disclosure, wherein example 16 also includes the subject matter according to any one of examples 1-15, above.

Further disclosed herein is a method for providing ambient lighting. The method comprising steps of passing a band through a housing of a lighting apparatus, comprising a plurality of light emitting diodes, and selectively removably attaching the lighting apparatus to a first object by securing the band to itself to form a loop. The method also comprises detaching the lighting apparatus from the first object by unsecuring the band from itself and selectively removably attaching the lighting apparatus to a second object by one of removing the band from the housing of the lighting apparatus and passing a strap of the second object through the housing of the lighting apparatus, or magnetically attaching the band to the second object. The preceding subject matter of this paragraph characterizes example 17 of the present disclosure.

The step of selectively removably attaching the lighting apparatus to the first object comprises flexing a first magnetic element of the band, flexing a second magnetic element of the band, and when flexed, magnetically coupling the first magnetic element and the second magnetic element. The preceding subject matter of this paragraph characterizes example 18 of the present disclosure, wherein example 18 also includes the subject matter according to example 17, above.

The second object comprises a magnetic surface. The step of selectively removably attaching the lighting apparatus to the second object comprises magnetically attaching a magnetic element of the band to the magnetic surface. The preceding subject matter of this paragraph characterizes example 19 of the present disclosure, wherein example 19 also includes the subject matter according to any one of examples 17-18, above.

Additionally disclosed herein is a system for providing ambient lighting. The system comprises a lighting apparatus. The lighting apparatus comprises a housing, a window formed in the housing, and light emitting diodes positioned within the housing and aligned to emit light through the window to an exterior of the housing. The system also comprises a band coupled to the lighting apparatus at the housing. A first end of the band is coupled to a connector. The band extends from the connector to pass through the lighting apparatus and form an inside loop extending from the lighting apparatus back around to the connector and forming an outside loop by passing through the connector and around an exterior of the inside loop and terminating at a second end of the band. The outside loop is magnetically coupled to the inside loop at approximately the second end of the band. The preceding subject matter of this paragraph characterizes example 20 of the present disclosure.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended numbered paragraphs or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
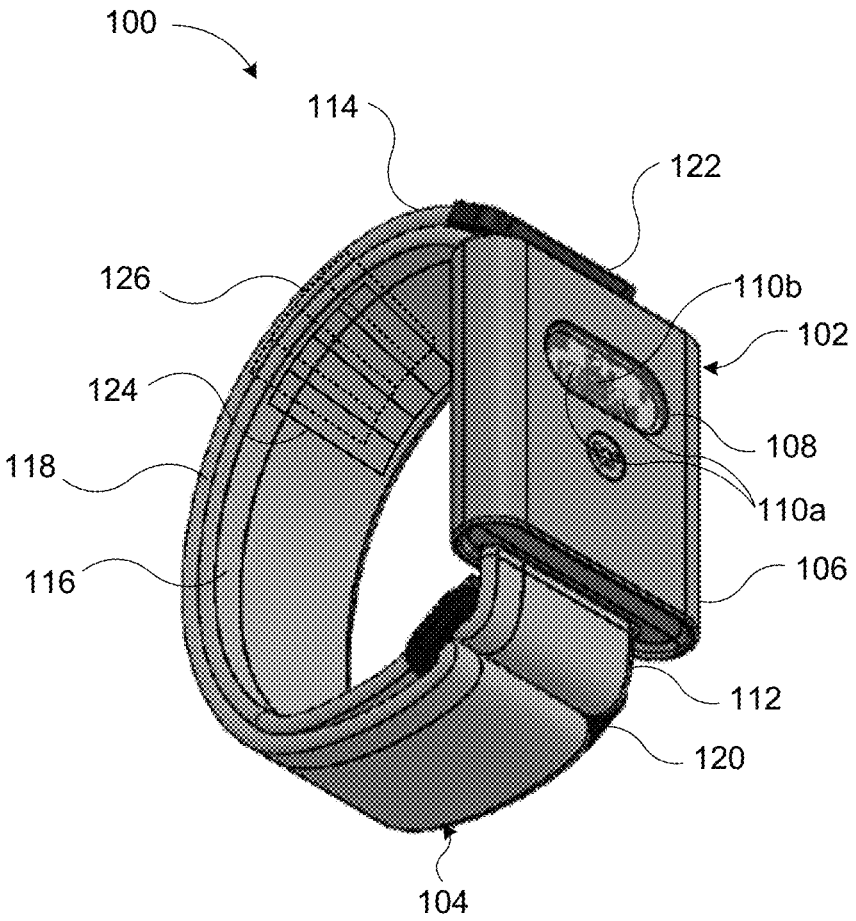
FIG. 1 is a schematic perspective view of a system for providing ambient lighting, according to one or more examples of the subject disclosure.

Referring to FIG. 1, a system 100 for providing ambient light is shown. In certain examples, the sole functionality of the system 100 is to provide ambient light. In other words, in some examples, the system 100 does not provide computing, entertainment, body condition monitoring, or other non-lighting functionality. In at least this manner, the system 100 is different from wearable computing devices, such as smart watches.

The system 100 includes a lighting apparatus 102 and a band 104. The band 104 is coupled to the lighting apparatus 102 to facilitate attachment of the lighting apparatus 102 to a person or object. As described in more detail below, the band 104 is permanently coupled to the lighting apparatus 102 in some examples and selectively removably coupled to the lighting apparatus 102 in other examples. The lighting apparatus 102 includes a housing 106, a window 108 formed in the housing 106, and light-emitting diodes 110*a-b* positioned within the housing 106 (e.g., in a spaced-apart manner) and aligned (e.g., linearly aligned) to emit light through the window 108 to an exterior of the housing 106.

The housing 106 of the lighting apparatus 102 provides structural protection and containment for the lighting apparatus 102. The housing 102 may be constructed of a rigid and durable material, such as metals, plastics, ceramic, composites, nylons, ABS, and the like. In one example, the housing 102 is made of nylon, which provides a durable, flexible, and longer lasting housing that can withstand temperatures and is easier to manufacture. The housing 106 has one or more rounded edges in certain examples. The rounded edges have a radius which continuously extends from a front face of the housing 106 to a rear side of the housing 106. In certain examples, the sides of the housing 106 are radiused or contoured and the ends of the housing 106 are mostly flat.

The rounded edges may facilitate a higher degree of comfort allowing for wrist flexure, reduce snagging and catching, and may allow for positioning of the system 100 for applications in which the system 100 is not positioned on the wrist of a user. The ends of the housing 106 near a first end 112 and a second end 114 of the band 104 may have a concave or recessed geometry. In other embodiments, these ends of the housing 106 may be radiused or convex in a manner similar to or different from the rounded edges described above. The housing 106 may provide structural integrity as well as intrusion resistance or proofing with respect to water, sweat, particulates, and the like.

The window 108 is disposed in the housing 106 to be front facing. In the illustrated embodiment, the window 108 has a stadium geometry. The window 108 may have other shapes, such as rectangular, round, oval, and the like. As shown, the window 108 is positioned to be nearer the end of the housing 106 corresponding to the second end 114 of the band 104 than the end of the housing 106 corresponding to the first end 112 of the band 104. The position of the window 108 corresponds to a position of the LEDs 110*a-b* to allow light generated by the LEDs 110*a-b* to exit the housing 106. The window 108 may provide no optic effect on the light or may apply a focusing, diffusing, filtering, and other optic effects on the light. For example, the window 108 may be configured to diffuse the light emitted by the LEDs 110*a-b*. The treatment of the light from the LEDs 110*a-b* by the window 108 may be different or similar for each of the plurality of LEDs 110*a-b*. Additionally, while the window 108 is shown as a single window, some embodiments may be a plurality of windows each of which correspond to one or more of the LEDs 110*a-b*.

The LEDs 110*a-b* are disposed within the housing 106. In some embodiments, the LEDs 110*a-b* are oriented to direct light in a single direction. In other embodiments, one or more of the LEDs 110*a-b* may be oriented to direct light in a direction which is different from the direction in which light from another of the LEDs 110*a-b* is directed. In some embodiments, the LEDs 110*a-b* include two white LEDs 110*a* and one red LED 110*b* positioned between the two white LEDs 110*a*. Other quantities, colors, positions, and the like may be used in the LEDs 110*a-b* of the lighting apparatus 102.

The lighting apparatus 102 may be configured to provide light at a consistent level via the LEDs 110*a-b* regardless of battery level. For example, the lighting apparatus 102 may provide the same level of light at full charge or on outside power as it does at 5% battery charge remaining. The consistent power level is achieved through the implementation of an electrical circuit, between the battery and the LEDs, that comprises a switch mode regulator or similar current regulator. For example, in one embodiment, the lighting apparatus 102 includes an electrical circuit that includes a boost-mode switching regulator that implements a constant-current source. The boost-mode switching regulator drives regulated current through the LEDs 110*a-b*. As battery, or other power source, voltage decreases, the boost-mode switching regulator compensates for the decline, monitoring and regulating the current that flows through the LEDs 110-*a-b* so that the brightness of the LEDs 110*a-b* remains approximately constant regardless of a charge level or other variables in the power source. This allows the LEDs 110-*a-b* to produce an expected and constant level of illumination until the power source is exhausted and the voltage provided by the power source is insufficient. As the lighting apparatus 102 reaches this exhausted state, the LEDs 110*a-b* will go from producing a constant illumination level to a shutdown or powered-off mode in which the LEDs 110*a-b* emit no light.

In contrast with traditional lighting devices, the lighting apparatus 102 has no period during which the LEDs 110*a-b* dim due to declining battery voltage. Instead, the LEDs 110*a-b* of the lighting apparatus 102 remain at full brightness until the power source is exhausted and shut-down is required. A consistent brightness or power level provides value in isolated or remote environments.

Furthermore, the lighting apparatus 102 provides lighting that is distinct from a traditional headlamp in that the lighting apparatus 102 produces light that is independent of a user's facing direction or field of view. Indirect or ambient light provided by the lighting apparatus 102 can be beneficial in that it can provide sufficient lighting for more than one user and to a greater area.

The band 104 couples to the lighting apparatus 102 at the housing 106. The band 104 has a first end 112 and a second end 114. The band 104 extends from the first end 112 through the lighting apparatus 102 and forms an inside loop 116 extending from the lighting apparatus 102 to a connector 120 coupled to the first end 112 of the band 104. The band 104 passes through the connector 120 and doubles back to form an outside loop 118 along an exterior side of the inside loop 116. The outside loop 118 ends at the second end 114 of the band 104. The band 104 includes a tab 122 on the second end 114 to provide a gripping location for adjusting the band 104.

The band 104 can be made of any of various materials. However, in one example, the band 104 is made of a laminated nylon-based material (such as multiple layers of nylon fabric bonded together in a stacked arrangement).

The connector 120 is shaped to be coupled to the first end 112 of the band 104 and allow the band 104 to also pass through the connector 120. The connector 120 may be configured to form a breakaway point in the system 100 to act as a designated point of failure in response to a dangerous level of force being applied to the system 100. The connector 120 forms the threshold between the inside loop 116 and the outside loop 118. The connector 120 may apply a friction force on the band 104 between the inside loop 116 and the outside loop 118 to facilitate more incremental sizing or may apply relatively little friction to reduce effort to adjust the position of the connector 120 along the band 104.

The band 104 also includes a first magnetic element 124. The first magnetic element 124 is disposed in or on the band 104 to be in the inside loop 116. The first magnetic element 124 is positioned in the band 104 at the inside loop 116 to correspond with a second magnetic element 126 disposed in the band 104 to be in the outside loop 118 and near the second end 114. The first magnetic element 124 interacts magnetically with the second magnetic element 126 to secure the outside loop 118 of the band 114 relative to the inside loop 116 of the band 104. This allows for the band 104 to be pulled by the tab 122 to move the band 104 though the connector 120 to size the inside loop 116 to the desired size and secure the second magnetic element 126 relative to the first magnetic element 124.

In some embodiments, one or both of the first magnetic element 124 and the second magnetic element 126 may be jointed, ribbed, segmented, flexible, or otherwise structured to provide flexure of the magnetic elements when magnetically coupled together. Additionally, the structure of one or both of the first magnetic element 124 and the second magnetic element 126 may have one or more pole pairs to facilitate distinct relative positions of the first magnetic element 124 relative to the second magnetic element 126. In other words, the interaction of the first magnetic element 124 with the second magnetic element 126 allows for multiple relative positions of the first magnetic element 124 with the second magnetic element 126 to secure the band 104. This allows for flexibility in sizing and flexibility in manner of use.

The inclusion of one or more magnetic elements, first magnetic element 124 and second magnetic element 126, also allows for connection of the strap 104 through clothing or other relatively thin structures. Additionally, one or more of the first magnetic element 124 and the second magnetic element 126 allows for securing the system 100 to metal or other magnetic surfaces or structures. This further expands the viable lighting options and situations in which the system 100 may be successfully implemented.

Figure 2:
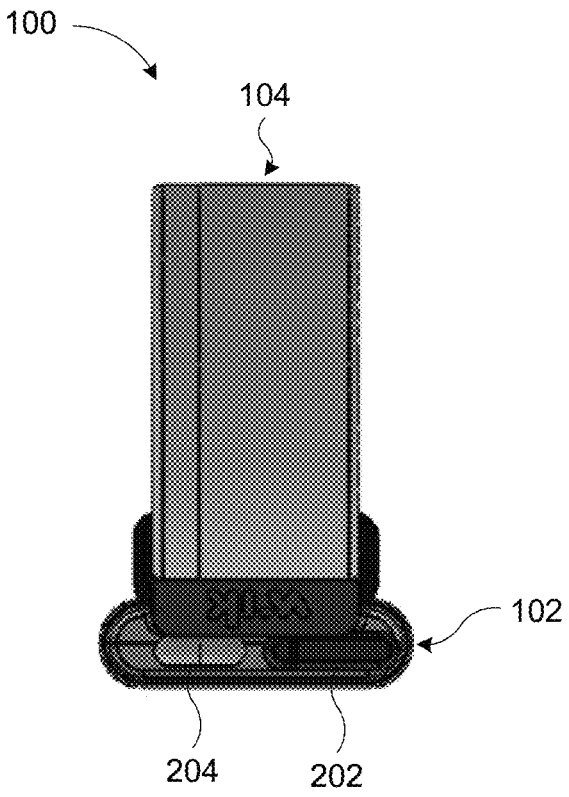
FIG. 2 is a schematic side view of the system of FIG. 1, according to one or more examples of the subject disclosure.

Referring to FIG. 2, the lighting apparatus 102 includes a charge port 202 and a control interface 204. The charge port 202 facilitates connection of a power source to charge or power the lighting apparatus 102. The charge port 202 may be any one of many different types, styles, or standardized or proprietary charging ports. Additionally, more than one charging port of the same or different types may be provided to receive or transmit power.

The control interface 204 is an interface which allows a user to operate the lighting apparatus 102. For example, the control interface 204 can facilitate an on/off operation or mode selection. For example, the control interface 204 may allow the user to select a number of LEDs to activate, a color of LED to activate, a power or brightness level, a steady on or flash mode, or the like. The control interface 204 may be a single operation interface or a multi-operation interface. For example, the control interface 204 may be a single operation interface which allows a single type of input to move through different settings, modes, and the like. The single input may be a button press, touch control, slide control, wheel spin, or other interface inputs. Alternatively, the multi-operation interface may be configured to receive a plurality of different types of inputs which may provide different operations in the lighting apparatus 102.

While the charge port 202 and the control interface 204 are shown as having a particular position relative to one another and individually on the lighting apparatus 102, different arrangements and positions may be used. In some embodiments, one or both of the charge port 202 and the control interface 204 are positioned on the illustrated end of the lighting apparatus 102 which may be concave or have an otherwise recessed geometry to provide impact protection, accidental activation protection, wear protection, or the like.

Figure 3:
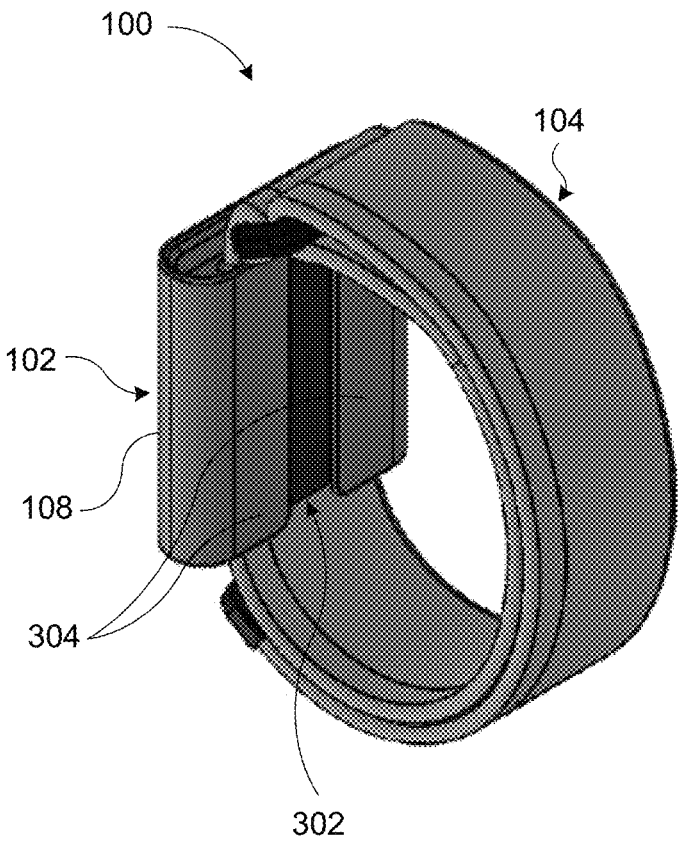
FIG. 3 is a schematic perspective view of a system for providing ambient lighting, according to one or more examples of the subject disclosure.

Referring now to FIG. 3, a band slot 302 is shown. The band slot 302 is formed in the housing 108 of the lighting device 102 to provide a quick mounting location for the band 104. The band slot 302 extends a length of the housing 108. The band slot 302 is defined between the housing 108 and retaining flaps 304. The retaining flaps 304 extend over corresponding portions of the band slot 302 on each side leaving a portion open which allows for a path for the band 104 to pass into or out of the band slot 302 while providing a retaining force with the retaining flaps 304. The band slot 302 may facilitate easy and simple installation and removal of the band 104 relative to the lighting apparatus 102. The band slot 302 may provide a breakaway point which allows the lighting apparatus 102 to separate from the band 104 in response to dangerous or damaging forces applied to the lighting apparatus 102. The breakaway feature reduces the chance of damage to the system 100 or injury to the user. This is particularly relevant in situations where a personal lighting device is desirable such as, for example, a high adventure, rescue, emergency response, and the like. In addition to accepting the strap 104 of the system 100, the band slot 302 also facilitates attachment of the lighting apparatus 102 to other similarly sized straps or similar structures. The ability to attach the lighting apparatus 102 to a backpack strap or other structure can improve the utility of the system 100, as described below.

The retaining flaps 304 may have rounded corners to provide increased resistance to snagging of the band, clothing, and the like and to increase user comfort by reducing hot spot pressure. The retaining flaps 304 may have a uniform and constant geometry along the length of the band slot 302 or one or more of the retaining flaps 304 may have a variable or non-constant geometry along the length of the band slot 302.

Figure 4:
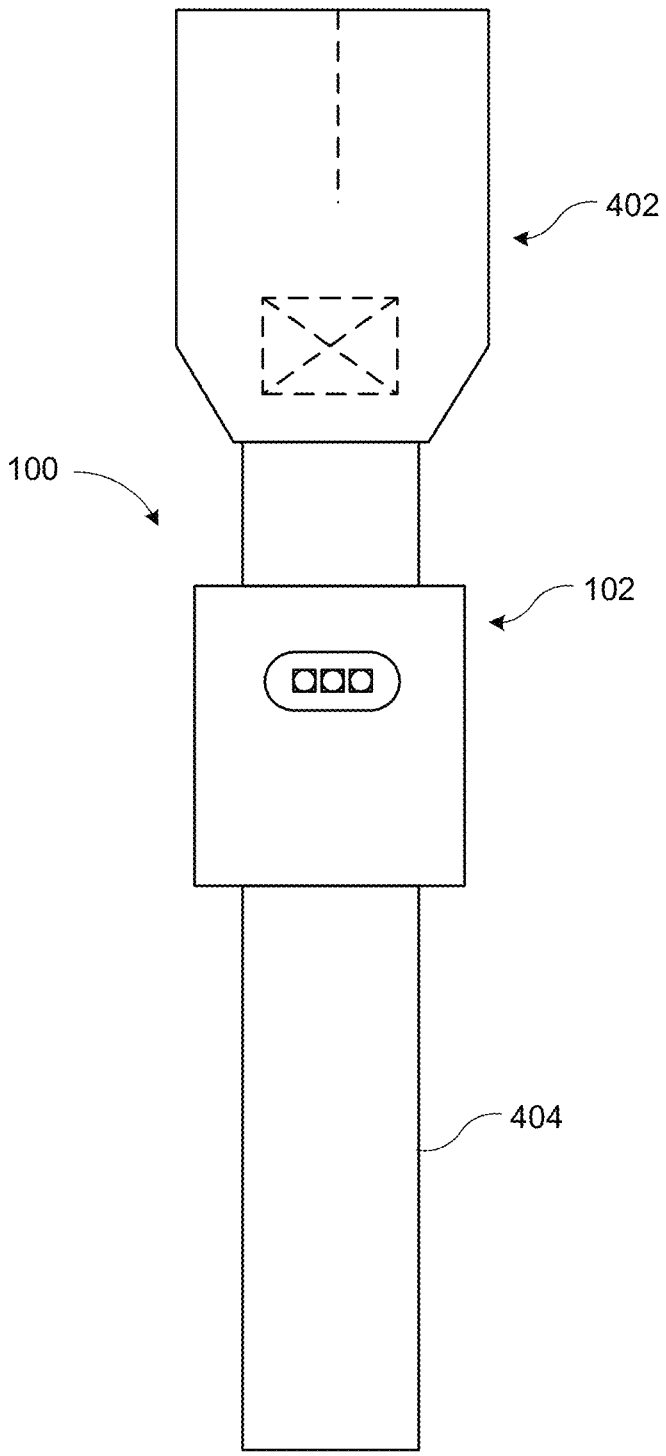
FIG. 4 is a schematic top plan view of a lighting apparatus for providing ambient lighting, shown selectively removably attached to a strap, according to one or more examples of the subject disclosure.

With reference to FIG. 4, the band slot 302 shown in FIG. 3 can be utilized to secure the lighting apparatus 102 to an arm strap 404 of a pack 402 or other structure. While the illustrated embodiment omits the strap 104 of the system 100 and attaches the lighting apparatus 102 alone, other embodiments may couple the system 100 to the pack 402 with the strap 104 of the system 100 in place.

Figure 5:
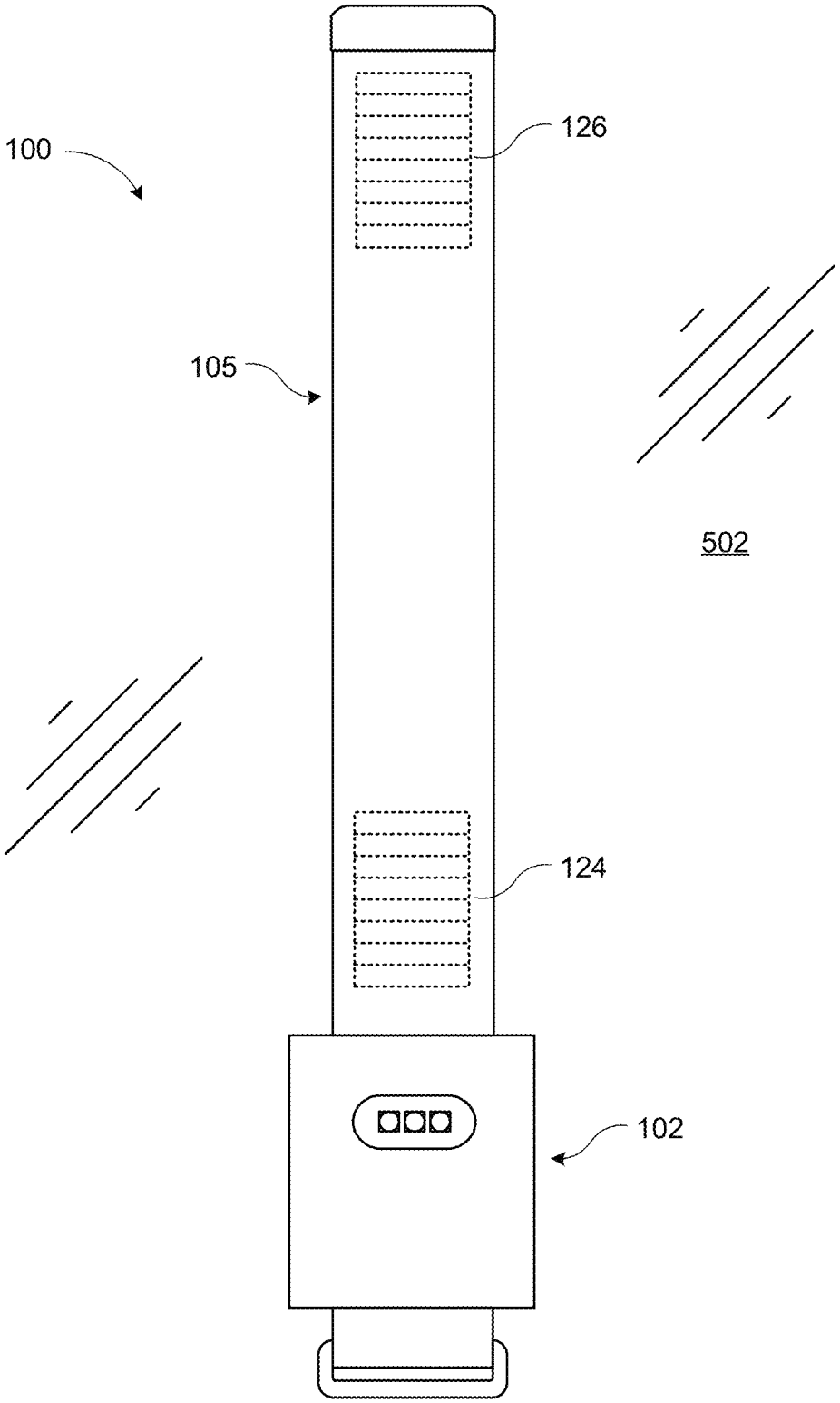
FIG. 5 is a schematic top plan view a lighting apparatus for providing ambient lighting, shown selectively removably attached to a magnetic surface, according to one or more examples of the subject disclosure.

As shown in FIG. 5, the system 100 may also be secured to a metallic or otherwise magnetic surface 502. For example, at least one of the first magnetic element 124 and the second magnetic element 126 may be aligned to apply a magnetic force to the surface 502 to secure the system 100 in place. This allows the system 100 to provide light in locations and situations where light may not otherwise be available or sufficient. In one example, the surface 502 may be a vehicle body or hood. In this example, the system 100 may provide sufficient light to change a tire or make other repairs or maintenance.

Figure 6:
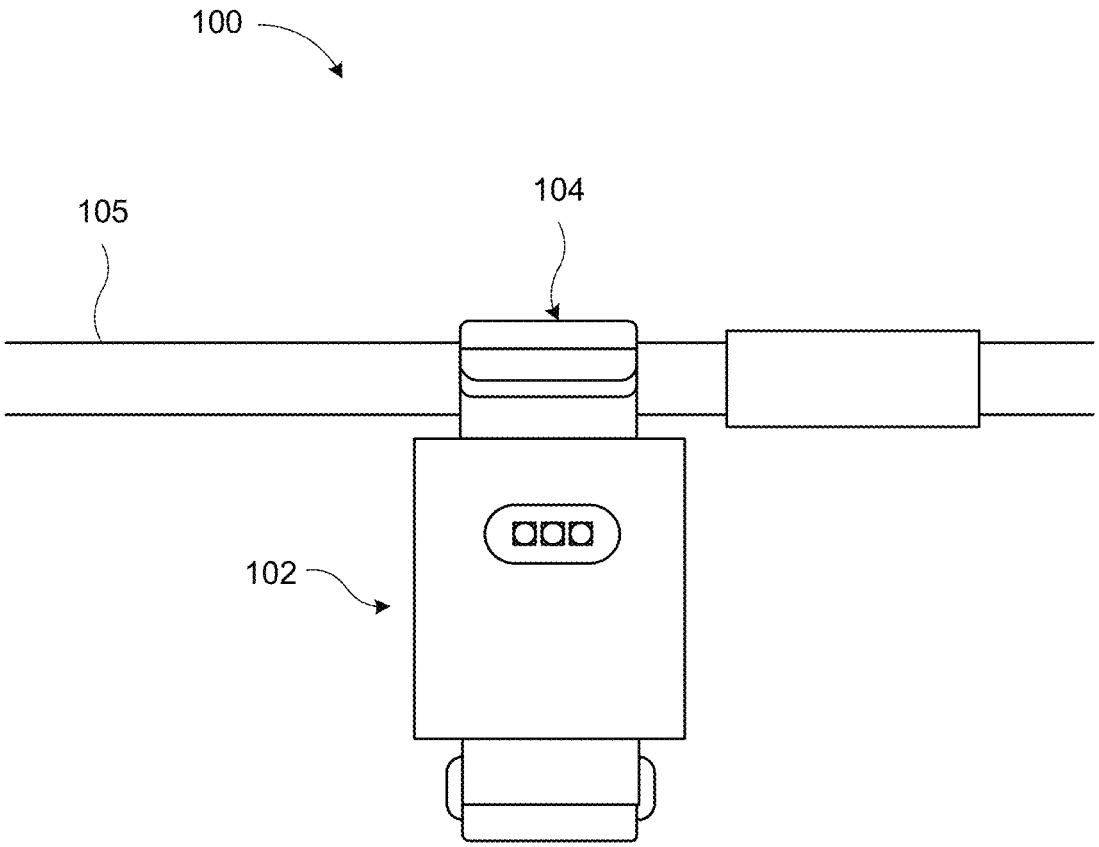
FIG. 6 is a schematic front view of a system for providing ambient lighting, shown selectively removably attached to a structure, according to one or more examples of the subject disclosure.

As shown in FIG. 6, the strap 104 of the system 100 may be wrapped around an elongated structure 105 such as a tent pole (shown), a rope, a tree branch, a belt, a handle, or the like. This further illustrates the capability and flexibility of the system 100 to provide light in diverse ways without needed to occupy the user's hands or correspond with a facing direction as would a traditional headlamp.

Disclosed herein is a method of using the lighting apparatus 102. The lighting apparatus 102 is used by activating the light. This is done by using the control interface 204 to cycle the lighting apparatus from off to on. In some examples, after the lighting apparatus is switched on, the mode of lighting is selected followed by the selection of color and brightness level.

Before or after the lighting apparatus has been activated the user determines a location to place the lighting apparatus 102 to provide adequate ambient lighting. After the location has been determined, the user attaches (e.g., selectively removably attaches) the lighting apparatus 102 to a first object in a first position that is safe and convenient.

The lighting apparatus may then be moved from attachment to the first object or the first position to attachment (e.g., selectively removable attachment) to a second object or a second position should ambient lighting needs change. The lighting apparatus 102 can be deactivated after the lighting needs are fulfilled. The deactivation of the lighting apparatus 102 can be performed similarly to the activation. For example, the user can use the control interface to cycle the lighting apparatus 102 to off.

The lighting apparatus 102 may be charged after use or after the battery has been exhausted. The lighting apparatus is charged by connecting a charging source to the charging port 202.

In the above description, certain terms may be used such as "up," "down," "upper," "lower," "horizontal," "vertical," "left," "right," "over," "under" and the like. These terms are used, where applicable, to provide some clarity of description when dealing with relative relationships. However, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive.

What is claimed is:

1. A system for providing ambient lighting, the system comprising:

a lighting apparatus comprising:

a housing, comprising:

a flat front face;

a flat rear face opposite and parallel with the flat front face;

at least one window formed in the flat front face and through which the non-focused light from a plurality of light emitting diodes passes;

opposing rounded edges defining continuously rounded surfaces extending from the flat front face to the flat rear face;

opposing flat edges, perpendicular to the opposing rounded edges and extending between the flat front face and the flat rear face:

opposing retaining flaps defining the rear face; and a band slot defined between the opposing retaining flaps, wherein the opposing retaining flaps couple a band to the housing, the band slot has a width that is less than a width of the band, and a thickness of the band is passable through the band slot;

the plurality of light emitting diodes positioned within the housing and configured to emit the non-focused light, through the flat front face, to an exterior of the housing;

at least one charge port formed in the housing; and a control interface integrated into the housing; and the band coupled to the housing and comprising a first end, a second end, a first magnetic element, and a second magnetic element coupleable with the first magnetic element such that the band forms a loop, wherein:

the first magnetic element comprises a plurality of magnetic segments that are jointed together and movable relative to each other;

the second magnetic element comprises a plurality of magnetic segments that are jointed together and movable relative to each other;

the second magnetic element is at the second end; and in a direction along the band, the first magnetic element is between the second magnetic element and the first end.

2. The system of claim 1, wherein the housing is made of nylon.

3. The system of claim 1, wherein a portion of the band extends from one side of the housing, the portion of the band includes the first end, but not the second end, and the first magnetic element and the second magnetic element are formed in and are spaced apart along the portion of the band.

4. The system of claim 1, wherein the lighting apparatus comprises at least three light emitting diodes.

5. The system of claim 4, wherein the at least three light emitting diodes are spaced apart from each other and linearly aligned across the flat front face of the housing.

6. The system of claim 4, wherein the at least three light emitting diodes comprises two white-light emitting diodes and one red-light emitting diode interposed between the two white-light emitting diodes.

7. The system of claim 4, wherein:

at least one of the at least three light emitting diodes emits light in a first direction; and at least one of the at least three light emitting diodes emits light in a second direction that is different than the first direction.

8. The system of claim 1, further comprising a connector, wherein:

the first end of the band is fixed to the connector;

the second end of the band is passable through the connector; and the second magnetic element is coupleable with the first magnetic element via a magnetic force between the second magnetic element and the first magnetic element.

9. The system of claim 1, wherein the plurality of light emitting diodes emit light in the same direction.

10. The system of claim 1, further comprising a battery housed within the housing, wherein the light emitting diodes emit light at a constant intensity independent of a depletion level of the battery.

11. The system of claim 10, further comprising an electrical circuit between the battery and the light emitting diodes, wherein the electrical circuit comprises a boost-mode switching regulator.

12. The system of claim 1, wherein the control interface is a single-operation interface.

13. The system of claim 1, wherein the band is slidable along the opposing retaining flaps while the opposing retaining flaps couple the band to the housing.

14. The system of claim 1, wherein the band is made of a laminated nylon material comprising at least two layers of nylon fabric bonded together in a stacked arrangement.

15. A method for providing ambient lighting, the method comprising steps of:

passing a band through a band slot of a housing of a lighting apparatus comprising a plurality of light emitting diodes configured to emit non-focused light, wherein the housing comprises:

a flat front face;

a flat rear face opposite and parallel with the flat front face;

at least one window formed in the flat front face and through which the non-focused light from the plurality of light emitting diodes passes;

opposing rounded edges defining continuously rounded surfaces extending from the flat front face to the flat rear face;

opposing flat edges, perpendicular to the opposing rounded edges and extending between the flat front face and the flat rear face; and opposing retaining flaps defining the rear face;

wherein the band slot is defined between the opposing retaining flaps, the opposing retaining flaps couple the band to the housing, the band slot has a width that is less than a width of the band, and a thickness of the band is passable through the band slot;

selectively removably attaching the lighting apparatus to a first object by securing the band to itself to form a loop;

detaching the lighting apparatus from the first object by unsecuring the band from itself; and selectively removably attaching the lighting apparatus to a second object by one of:

removing the band from the housing of the lighting apparatus and passing a strap of the second object through the housing of the lighting apparatus; or magnetically attaching the band to the second object, wherein the band comprises a first end, a second end, a first magnetic element, and a second magnetic element coupleable with the first magnetic element such that the band forms a loop, and wherein:

the first magnetic element comprises a plurality of magnetic segments that are jointed together and movable relative to each other;

the second magnetic element comprises a plurality of magnetic segments that are jointed together and movable relative to each other;

the second magnetic element is at the second end; and in a direction along the band, the first magnetic element is between the second magnetic element and the first end.

16. The method of claim 15, wherein the step of selectively removably attaching the lighting apparatus to the first object comprises:

flexing the first magnetic element of the band;

flexing the second magnetic element of the band; and when flexed, magnetically coupling the first magnetic element and the second magnetic element.

17. The method of claim 15, wherein:

the second object comprises a magnetic surface; and the step of selectively removably attaching the lighting apparatus to the second object comprises magnetically attaching the first magnetic element and the second magnetic element of the band to the magnetic surface.

18. A system for providing ambient lighting, the system comprising:

a band;

a connector; and a lighting apparatus comprising:

a housing, comprising:

a flat front face;

a flat rear face opposite and parallel with the flat front face;

at least one window formed in the flat front face and through which the non-focused light from a plurality of light emitting diodes passes;

opposing rounded edges defining continuously rounded surfaces extending from the flat front face to the flat rear face;

opposing flat edges, perpendicular to the opposing rounded edges and extending between the flat front face and the flat rear face;

opposing retaining flaps defining the rear face; and a band slot defined between the opposing retaining flaps, wherein the opposing retaining flaps couple the band to the housing, the band slot has a width that is less than a width of the band, and a thickness of the band is passable through the band slot;

a window formed in the flat front fact of the housing; and light emitting diodes positioned within the housing and aligned to emit the light through the window to an exterior of the housing;

wherein:

the band is coupled to the lighting apparatus at the housing;

a first end of the band is coupled to the connector;

the band extends from the connector to pass through the lighting apparatus and form an inside loop extending from the lighting apparatus back around to the connector and forming an outside loop by passing through the connector and around an exterior of the inside loop and terminating at a second end of the band;

the outside loop is magnetically coupled to the inside loop at approximately the second end of the band;

the band comprises a first magnetic element that comprises a plurality of magnetic segments that are jointed together and movable relative to each other;

the band comprises a second magnetic element that comprises a plurality of magnetic segments that are jointed together and movable relative to each other;

the second magnetic element is at the second end; and in a direction along the band, the first magnetic element is between the second magnetic element and the first end.

* * * * *